US009175679B2

(12) United States Patent
Shimizu et al.

(10) Patent No.: US 9,175,679 B2
(45) Date of Patent: Nov. 3, 2015

(54) ELECTROMAGNETIC PUMP

(75) Inventors: Tetsuya Shimizu, Anjo (JP); Kazuhiko Kato, Kariya (JP); Noriomi Fujii, Anjo (JP); Kazunori Ishikawa, Toyota (JP)

(73) Assignee: AISIN AW CO., LTD., Anjo (JP)

( * ) Notice: Subject to any disclaimer, the term of this patent is extended or adjusted under 35 U.S.C. 154(b) by 1127 days.

(21) Appl. No.: 13/147,728

(22) PCT Filed: May 10, 2010

(86) PCT No.: PCT/JP2010/058242

§ 371 (c)(1),
(2), (4) Date: Aug. 3, 2011

(87) PCT Pub. No.: WO2010/146952

PCT Pub. Date: Dec. 23, 2010

(65) Prior Publication Data

US 2011/0293449 A1 Dec. 1, 2011

(30) Foreign Application Priority Data

Jun. 18, 2009 (JP) ..... 2009-145262
Sep. 30, 2009 (JP) ..... 2009-226746

(51) Int. Cl.
*F04B 17/04* (2006.01)
*F04B 53/12* (2006.01)

(52) U.S. Cl.
CPC ..... *F04B 53/12* (2013.01); *F04B 17/044* (2013.01); *F04B 17/048* (2013.01)

(58) Field of Classification Search
CPC ..... F04B 17/03; F04B 17/04; F04B 17/042; F04B 17/044; F04B 39/0016
USPC ..... 417/416, 417, 554
See application file for complete search history.

(56) References Cited

U.S. PATENT DOCUMENTS

| | | | | |
|---|---|---|---|---|
| 4,300,873 | A | 11/1981 | Mowbray et al. | |
| 4,775,301 | A * | 10/1988 | Cartwright et al. | 417/417 |
| 5,567,131 | A * | 10/1996 | McNaull | 417/417 |
| 2007/0065320 | A1 * | 3/2007 | Walch et al. | 417/554 |

FOREIGN PATENT DOCUMENTS

| | | |
|---|---|---|
| GB | 2 241 287 A | 8/1991 |
| JP | A-11-82293 | 3/1999 |

(Continued)

OTHER PUBLICATIONS

International Search Report dated Sep. 27, 2010 in International Application No. PCT/JP2010/058242.

*Primary Examiner* — Charles Freay
*Assistant Examiner* — Philip Stimpert
(74) *Attorney, Agent, or Firm* — Oliff PLC

(57) ABSTRACT

A piston is slidably provided in a cylinder and partitions a first pump chamber, and a second pump chamber connected to an object to be operated. A first on-off valve is provided between the first pump chamber and the outside. A second on-off valve is provided in a connecting flow passage that connects the first pump chamber and the second pump chamber to each other. When the piston is moved forward by an electromagnetic force of a solenoid portion, a capacity of the first pump chamber decreases, and a capacity of the second pump chamber increases. When the piston is moved backward by a biasing force of a spring, the capacity of the first pump chamber increases, and the capacity of the second pump chamber decreases. A pressure receiving area of the front face of the piston is larger than that of the back face thereof.

12 Claims, 4 Drawing Sheets

(56) References Cited

FOREIGN PATENT DOCUMENTS

| | | |
|---|---|---|
| JP | A-2006-169993 | 6/2006 |
| JP | A-2006-300023 | 11/2006 |
| JP | A-2007-051567 | 3/2007 |
| JP | A-2009-7976 | 1/2009 |

* cited by examiner

ELECTROMAGNETIC PUMP

BACKGROUND OF THE INVENTION

1. Field of the Invention

The present invention relates to an electromagnetic pump.

2. Description of the Related Art

One electromagnetic pump that has been proposed includes: a piston that is inserted in a cylinder, and forms a pump chamber; an electromagnetic coil for generating an attractive force that attracts a piston; and a spring member for pressing the piston in a direction opposite to the attractive force of the electromagnetic coil by a spring force (see, e.g., Japanese Patent Application Publication No. JP-A-2007-51567). When the electromagnetic coil is not excited (OFF), this electromagnetic pump introduces oil therein by moving the piston with the spring force of the spring member. When the electromagnetic coil is excited (ON), this electromagnetic pump discharges the introduced oil by moving the piston with the attractive force of the electromagnetic coil.

Another proposed electromagnetic pump operates so that, when an electromagnetic coil is excited, the electromagnetic pump introduces oil therein by moving a piston with an attractive force of the electromagnetic coil, and when the electromagnetic coil is not excited, the electromagnetic pump discharges the introduced oil by moving the piston with a spring force of a spring member (see, e.g., Japanese Patent Application Publication No. JP-A-2009-7976).

One plunger pump that has been proposed includes: a plunger (a piston) that partitions a discharge chamber V1 (a first chamber) connected to an inlet via a check valve, and a discharge chamber V2 (a second chamber) communicating with the discharge chamber V1 via a check valve, and connected to an outlet, and reciprocates within a cylinder; an eccentric cam that moves the plunger forward by driving a motor; and a coil spring that moves the plunger backward (see, e.g., Japanese Patent Application Publication No. JP-A-2006-169993). In this pump, when the plunger is pressed by the eccentric cam to move forward, the capacity of the discharge chamber V2 decreases, and the capacity of the discharge chamber V1 increases, whereby a liquid in the discharge chamber V2 is discharged from the outlet, and a liquid is introduced into the discharge chamber V1 via the inlet. When the plunger is moved rearward by a spring force of the coil spring with rotation of the eccentric cam, the capacity of the discharge chamber V1 decreases, and the capacity of the discharge chamber V2 increases, whereby the liquid in the discharge chamber V1 is fed into the discharge chamber V2. An amount of change in capacity of the discharge chamber V1 is larger than an amount of change in capacity of the discharge chamber V2. Thus, when the plunger is pressed by the eccentric cam to move forward, the liquid is discharged from the outlet by an amount corresponding to a change in capacity of the discharge chamber V2. When the plunger is moved backward by the spring force of the coil spring, the liquid is discharged from the outlet by an amount corresponding to the difference between a decrease in capacity of the discharge chamber V1 and an increase in capacity of the discharge chamber V2.

In general, the attractive force that is obtained by electromagnetic coils is relatively weak, and the coils need to be increased in size in order to obtain sufficient pressure-feed capability as electromagnetic pumps. On the other hand, due to space limitations in vehicles for mounting a hydraulic system including an electromagnetic pump, it is desired to reduce the size of electromagnetic pumps as much as possible while improving their performance. Moreover, when the electromagnetic pumps are used continuously, generation of an electromagnetic force can become unstable due to, e.g., heat generated in an electromagnetic portion. Thus, it is desired to improve the performance of the electromagnetic pumps.

SUMMARY OF THE INVENTION

The present invention provides an electromagnetic pump having improved performance and a reduced size.

An electromagnetic pump according to a first aspect of the present invention includes: a piston that is slidably provided in a cylinder and partitions a first fluid chamber and a second fluid chamber connected to an object to be operated; an electromagnetic portion that moves the piston forward by an electromagnetic force; an elastic member that moves the piston backward by applying an elastic force to the piston in a direction opposite to that of the electromagnetic force of the electromagnetic portion; a first on-off valve that allows working fluid to flow from outside into the first fluid chamber and prevents working fluid from flowing from the first fluid chamber to the outside; and a second on-off valve that is provided in a connecting flow passage that connects the first fluid chamber and the second fluid chamber to each other, allows working fluid to flow from the first fluid chamber into the second fluid chamber, and prevents working fluid from flowing from the second fluid chamber into the first fluid chamber. A capacity of the first fluid chamber reduces and a capacity of the second fluid chamber increases when the piston is moved forward, and the capacity of the first fluid chamber increases and the capacity of the second fluid chamber reduces when the piston is moved backward. A change in capacity of the first fluid chamber is larger than a change in capacity of the second fluid chamber in a reciprocating motion of the piston.

In the electromagnetic pump according to the first aspect of the present invention, by the electromagnetic force of the electromagnetic portion, working fluid is fed from the first fluid chamber into the second fluid chamber, and working fluid is discharged from the second fluid chamber to the object to be operated, by an amount corresponding to the difference between a change in capacity of the first fluid chamber and a change in capacity of the second fluid chamber. By the elastic force of the elastic member, working fluid is introduced into the first fluid chamber, and working fluid in the second fluid chamber is discharged to the object to be operated. Thus, the pressure-feeding capability can be improved over pumps in which working fluid in a fluid chamber is compressed and pressure-fed to an object to be operated only by the electromagnetic force of an electromagnetic portion, and pumps in which working fluid in a fluid chamber is compressed and pressure-fed to an object to be operated only by the elastic force of an elastic member. The use of an electromagnetic pump that satisfies a necessary and sufficient pressure-feeding capability enables the pump to be reduced in size. Working fluid is pressure-fed from the first fluid chamber to the object to be operated via the second on-off valve and the second fluid chamber by the electromagnetic force of the electromagnetic portion, and working fluid is pressure-fed from the second fluid chamber directly to the object to be operated by the elastic force of the elastic member. Thus, a more stable discharge pressure can be obtained by using an elastic member having a relatively weak elastic force, as compared to electromagnetic pumps in which working fluid is pressure-fed from the second fluid chamber directly to the object to be operated by the electromagnetic force of the electromagnetic portion, and working fluid is pressure-fed from the first fluid chamber to the object to be operated via the second on-off valve and the second fluid chamber by the elastic force of the elastic member. The electromagnetic force of the electromagnetic portion moves the piston forward against the elastic force of the elastic member. Thus, the use of an elastic member having a relatively weak elastic force can reduce the electromagnetic force required for the electromagnetic portion to a relatively small value. The "first on-off valve" and the "second on-off valve" may be check valves.

In the above structure, an area of a pressure receiving surface of the piston in the first fluid chamber may be larger than that of a pressure receiving surface of the piston in the second fluid chamber.

A fluid pressure of working fluid that is discharged from the second fluid chamber to the object to be operated when the piston is moved backward by the elastic force of the elastic member, may be larger than that of working fluid that is discharged from the first fluid chamber to the object to be operated via the second on-off valve and the second fluid chamber when the piston is moved forward by the electromagnetic force of the electromagnetic portion. Thus, the peak of a discharge pressure in each cycle of the electromagnetic pump can be set by the elastic force of the elastic member, whereby working fluid can be discharged without being affected by a change in electromagnetic force of the electromagnetic portion, which occurs, for example, when heat is generated.

The piston may include a cylindrical piston main body and a shaft portion that is connected to the piston main body and has an outer diameter smaller than that of the piston main body. The cylinder may include a slide surface on which the piston main body slides and a slide surface on which the shaft portion slides, where these slide surfaces are formed so that there is a difference in level therebetween in the cylinder. The second fluid chamber may be a space surrounded by the cylinder and the piston, with the piston being inserted in the cylinder. Thus, performance can be improved by merely performing simple processing.

The electromagnetic portion may include a mover that drives the piston and a case that accommodates the mover. The mover may move away from the case by the electromagnetic force when the electromagnetic portion is energized. The mover may move toward the case together with the piston by the elastic force of the elastic member when the electromagnetic portion is deenergized. By applying this structure to the first aspect of the present invention, working fluid in the second fluid chamber serves as a resistance when the piston is moved backward by the elastic force of the elastic member. This can prevent a collision between the mover and the case which occurs when the piston is moved backward fast, and thus, can reduce generation of abnormal noises such as a sound of the collision. As used herein, the "mover" includes a mover that is formed separately from the shaft portion of the piston, and a mover that is formed integrally with the shaft portion of the piston.

The first and second on-off valves may be built into the cylinder. This can make an overall system more compact when the electromagnetic pump is incorporated into the system. The second on-off valve may be built into the piston. In this case, the second on-off valve may include a main body formed integrally with the piston and an open/close member that opens and closes the central hole. The main body may include a central hole formed around the same axis as the piston and a through hole formed radially so as to communicate with the central hole. The central hole and the through hole may be used as the connecting flow passage that communicates the first fluid chamber and the second fluid chamber to each other. This enables a more compact electromagnetic pump to be implemented.

The elastic member may be attached to the first fluid chamber.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF THE EMBODIMENTS

An embodiment of the present invention will be described below.

Figure 1:
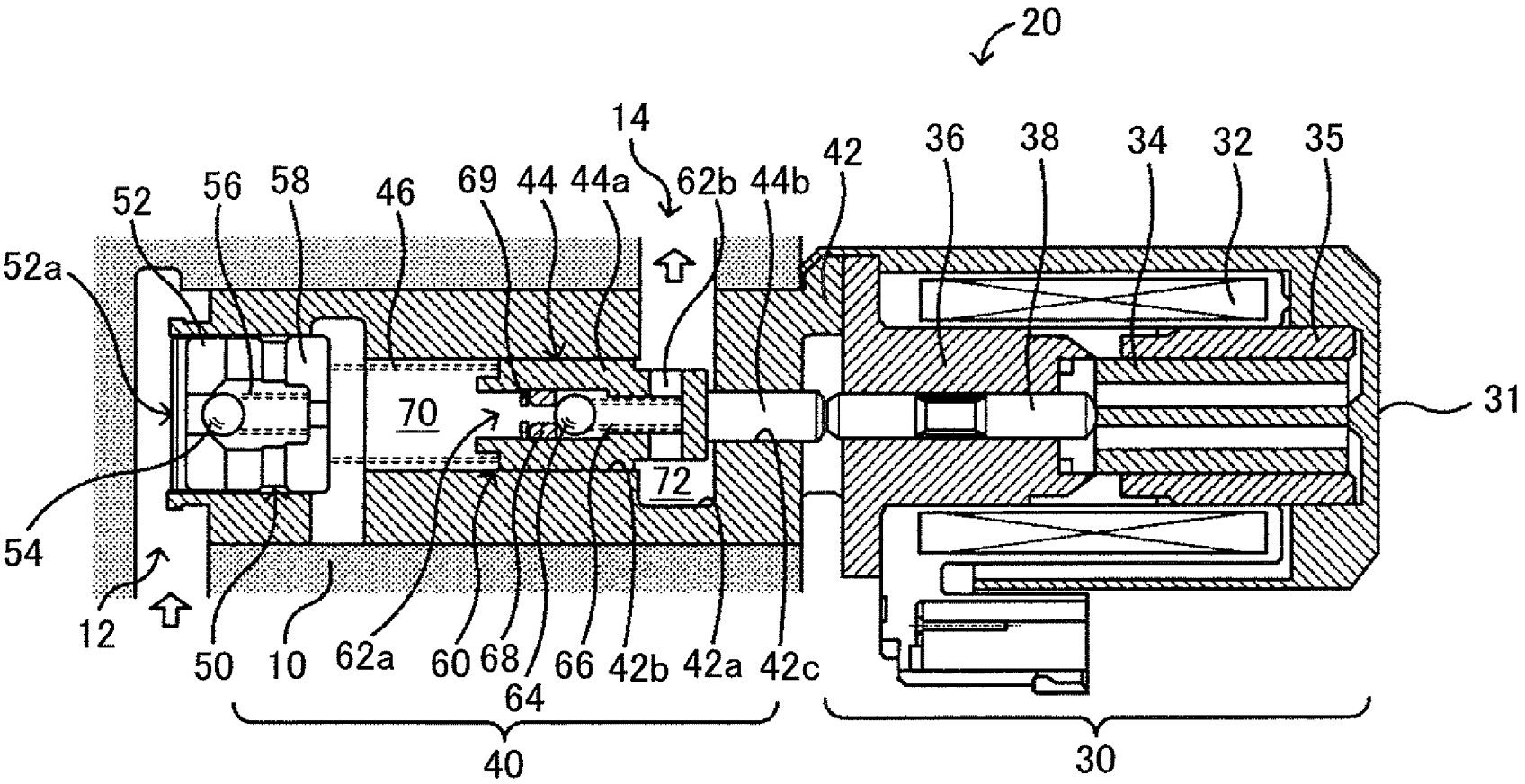
FIG. 1 is a structural diagram showing an overview of the structure of an electromagnetic pump according to an embodiment of the present invention.

FIG. 1 is a structural diagram showing an overview of the structure of an electromagnetic pump 20 according to an embodiment of the present invention. As shown in FIG. 1, the electromagnetic pump 20 of the present embodiment is a piston pump for pressure-feeding hydraulic oil by reciprocating a piston 44 with an electromagnetic force, and includes a solenoid portion 30 and a pump portion 40. For example, this electromagnetic pump 20 is incorporated into a valve body 10 as a part of a hydraulic circuit for turning on/off clutches and brakes included in an automatic transmission that is mounted on a vehicle.

In the solenoid portion 30, an electromagnetic coil 32, a plunger 34 as a mover, and a core 36 as a stator are positioned in a case 31 as a bottomed cylindrical member. A magnetic circuit, which is formed by applying a current to the electromagnetic coil 32, attracts the plunger 34 to push out a shaft 38 that is in contact with a tip end of the plunger 34.

The pump portion 40 includes a hollow cylindrical cylinder 42, a piston 44, a spring 46, an intake check valve 50, and a discharge check valve 60. The piston 44 is inserted in the cylinder 42, and is positioned so as to be slidable coaxially with the shaft 38 of the solenoid portion 30. The spring 46 applies a biasing force to the piston 44 in a direction opposite to that of an electromagnetic force of the solenoid portion 30. The intake check valve 50 is positioned at an end in the cylinder 42, and functions also as an end plate for receiving the spring 46. The discharge check valve 60 is positioned in the cylinder 42, and formed partially integrally with the piston 44.

The piston 44 is formed by a cylindrical piston main body 44*a*, and a shaft portion 44*b* having an outer diameter smaller than that of the piston main body 44*a*. The shaft portion 44*b* is in contact with a tip end of the shaft 38 of the solenoid portion 30. As the shaft 38 of the solenoid portion 30 is pushed out, the piston 44 is pushed while sliding in the cylinder 42.

The intake check valve 50 includes a hollow cylindrical main body 52, a ball 54, a spring 56, and a hollow cylindrical spring receiver 58. In the main body 52, a central hole 52*a* is formed around an axis of the main body 52. The central hole 52*a* has a larger diameter portion and a smaller diameter portion so as to have a stepped portion therebetween. The ball 54 is inserted in the central hole 52. The spring 56 presses the ball 54 against the main body 52 of the smaller diameter side. The spring receiver 58 is attached to the main body 52 by press-fitting or screwing, to receive the spring 56. When a positive pressure is generated downstream of the intake check valve 50, the ball 54 closes the central hole 52*a* by a biasing force of the spring 56, and the intake check valve 50 is closed. When a negative pressure is generated downstream of the intake check valve 50, the ball 54 opens the central hole 52*a* while compressing the spring 56, whereby the intake check valve 50 is opened. Note that the joint between the main body 52 and the spring receiver 58 is caulked from its outer surface in a diameter-reducing direction so that the connection therebetween is not loosened. The central hole 52*a* of the intake check valve 50 communicates with an intake oil passage 12 connected to an oil pan. Note that, as used herein, the "negative pressure" means that the pressure downstream of the intake check valve 50 is lower than the pressure upstream of the intake check valve 50, and the pressure difference therebetween exceeds a threshold value corresponding to the biasing force of the spring 56, and the "positive pressure" means that the pressure downstream of the intake check valve 50 has any value other than the negative pressure described above.

The discharge check valve 60 is formed by a main body, a spring 66, a ball 64, a hollow cylindrical ball receiver 68, and a snap ring 69. The main body is formed integrally with the piston main body 44*a*. In the main body, a concave central hole 62*a* is formed around an axis of the piston body 44*a*, and a through hole 62*b* communicating with the central hole 62*a* is formed radially. The spring 66 is inserted in the central hole 62*a*, and the bottom of the central hole 62*a* serves as a spring receiver. The ball 64 is inserted into the central hole 62*a* after the spring 66 is inserted therein. The ball receiver 68 is inserted in the central hole 62*a* to receive the ball 64. The snap ring 69 is provided to fix the ball receiver 68 to the main body (the piston main body 44*a*). When a negative pressure is generated upstream of the discharge check valve 60, the ball 64 closes the central hole 62*a* by a biasing force of the spring 66, whereby the discharge check valve 60 is closed. When a positive pressure is generated upstream of the discharge check valve 60, the ball 64 opens the central hole 62*a* while compressing the spring 66, whereby the discharge check valve 60 is opened.

A first pump chamber 70 is formed by a space surrounded by the inner wall of the cylinder 42, the front face of the piston main body 44*a*, and the intake check valve 50. When the electromagnetic force of the solenoid portion 30 is removed, and the piston 44, which has been pushed out by the electromagnetic force of the solenoid portion 30, is pushed back by the biasing force of the spring 46, the capacity of the first pump chamber 70 increases, and a negative pressure is generated in the first pump chamber 70. Thus, the hydraulic oil is introduced into the first pump chamber 70. When the piston 44 is pushed out by the electromagnetic force of the solenoid portion 30, the capacity of the first pump chamber 70 decreases, and a positive pressure is generated in the first pump chamber 70. Thus, the introduced hydraulic oil is discharged out of the first pump chamber 70.

The cylinder 42 has a groove 42*a* that is formed along the entire circumference of the inner wall of the cylinder 42 near a location where the solenoid portion 30 is attached to the cylinder 42, a slide surface 42*b* on which the piston main body 44*a* slides, and a slide surface 42*c* on which the shaft portion 44*b* slides. The slide surface 42*c* has a smaller inner diameter than that of the slide surface 42*b*, and the slide surface 42*b* and the slide surface 42*c* are positioned with the groove 42*a* interposed therebetween, so that there is a difference in level between the slide surfaces 42*b* and 42*c* in the cylinder 42. With the piston 44 being inserted in the cylinder 42, the cylinder 42 forms a space surrounded by the groove 42*a* and the back face of the piston main body 44*a*. The piston 44 is formed by the cylindrical piston main body 44*a*, and the shaft portion 44*b* having a smaller outer diameter than that of the piston main body 44*a*. Thus, the capacity of this space increases when the piston 44 is pushed out by the electromagnetic force of the solenoid portion 30, and decreases when the piston 44 is pushed back by the biasing force of the spring 46. Thus, this space functions as a pump chamber for pressure-feeding the hydraulic oil contained therein as the piston 44 is pushed back by the biasing force of the spring 46. This space is hereinafter referred to as a "second pump chamber 72." The second pump chamber 72 communicates with the first pump chamber 70 via the central hole 62*a* and the through hole 62*b* of the discharge check valve 60, and communicates with a discharge oil passage 14 connected to devices that are driven hydraulically, such as clutches. Note that the capacity of the first pump chamber 70 is changed by the front face of the piston main body 44*a*, and the capacity of the second pump chamber 72 is changed by the rear face of the piston main body 44*a* to which the shaft portion 44*b* is connected. Thus, a change in capacity of the first pump chamber 70 is larger than a change in capacity of the second pump chamber 72.

Figure 2A:
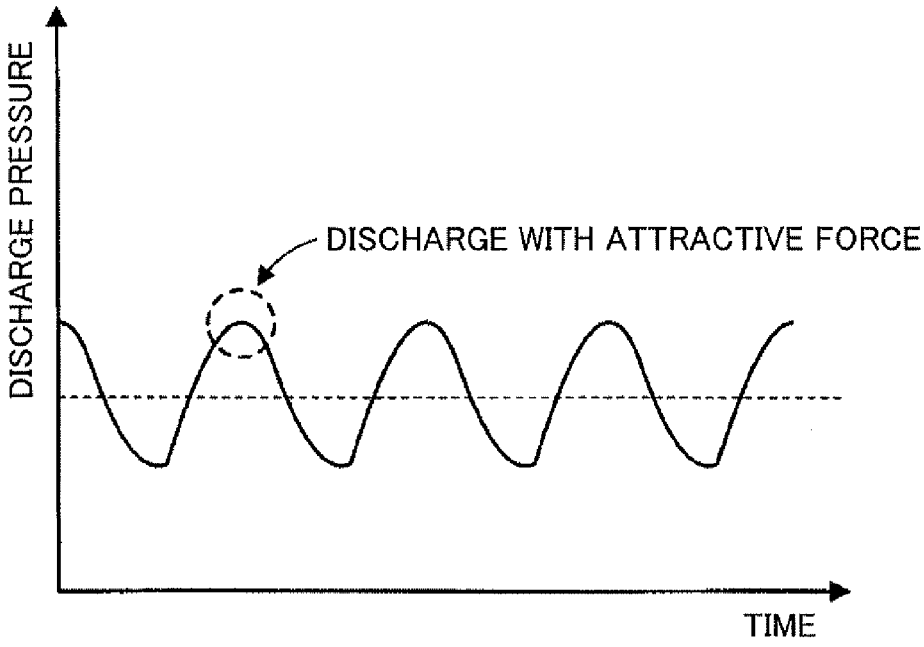
FIG. 2A is a graph illustrating how the discharge pressure of an electromagnetic pump of a comparative example of the present invention changes.
Figure 2B:
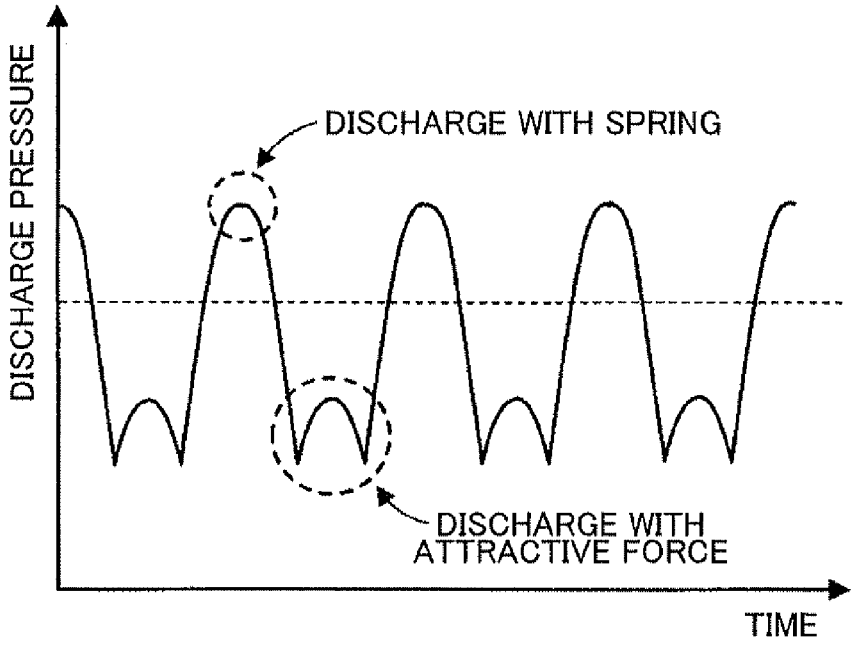
FIG. 2B is a graph illustrating how the discharge pressure of the electromagnetic pump of the embodiment changes.
Figure 3:
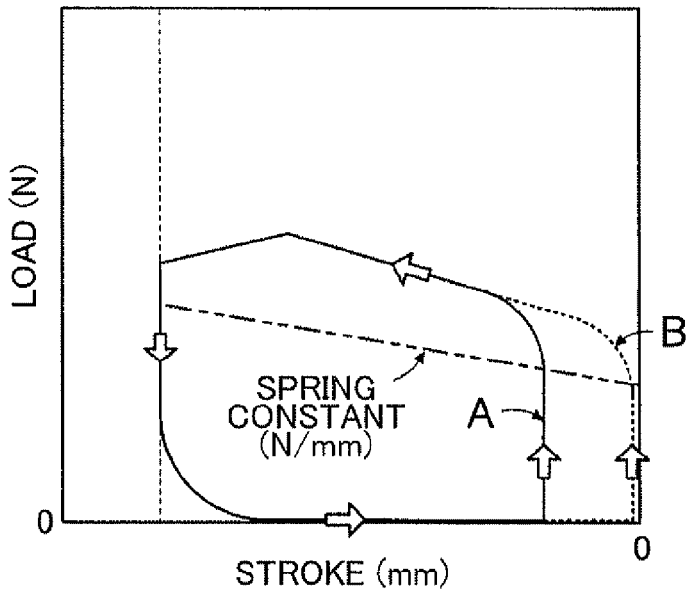
FIG. 3 is a graph illustrating how a stroke of the electromagnetic pump of the embodiment changes.

When the electromagnetic coil 32 is energized in the magnetic pump 20 of the embodiment structured as described above, the piston 44 is pushed out by the electromagnetic force of the solenoid portion 30 while compressing the spring 46. When the electromagnetic coil 32 is deenergized, the piston 44 is pushed back by the biasing force of the spring 46. Thus, the capacity of the first pump chamber 70 increases, and a negative pressure is generated in the first pump chamber 70. Therefore, the intake check valve 50 is opened, and the discharge check valve 60 is closed, whereby hydraulic oil is introduced from the oil pan into the first pump chamber 70 via the intake oil passage 12 and the intake check valve 50. Then, when the electromagnetic coil 32 is energized, the piston 44 is pushed out against the biasing force of the spring 46. Thus, the capacity of the first pump chamber 70 decreases, and a positive pressure is generated in the first pump chamber 70. Therefore, the intake check valve 50 is closed, and the discharge check valve 60 is opened, whereby the hydraulic oil in the first pump chamber 70 is fed to the second pump chamber 72. As described above, when the electromagnetic coil 32 is deenergized, the electromagnetic force is removed, and the piston 44 is pushed back by the biasing force of the spring 46. Thus, the capacity of the first pump chamber 70 increases, and a negative pressure is generated in the first pump chamber 70, whereby hydraulic oil is introduced into the first pump chamber 70. On the other hand, since the capacity of the second pump chamber 72 decreases, a positive pressure is generated in the second pump chamber 72. Thus, when the electromagnetic coil 32 is energized, the piston 44 is pushed out by the electromagnetic force of the solenoid portion 30, whereby hydraulic oil in the first pump chamber 70 is compressed, and is fed into the second pump chamber 72. When the electromagnetic coil 32 is deenergized, and the electromagnetic force is removed, the piston 44 is pushed back by the biasing force of the spring 46, whereby the hydraulic oil in the second pump chamber 72 is compressed, and pressure-fed. That is, the hydraulic oil can be compressed and pressure-fed during both forward and backward movements in the reciprocating motion of the piston 44. FIG. 2A shows how the deliver pressure of an electromagnetic pump of a comparative example changes, and FIG. 2B shows how the discharge pressure of the electromagnetic pump 20 of the embodiment changes. In FIGS. 2A and 2B, a thin dashed line indicates an average discharge pressure. FIG. 3 shows how the stroke of the electromagnetic pump 20 of the embodiment changes. FIG. 2A shows an operation of the electromagnetic pump of the comparative example which discharges hydraulic oil only by the electromagnetic force of a solenoid portion. FIG. 2B shows an operation of the electromagnetic pump 20 of the embodiment. In the embodiment, hydraulic oil is also compressed when the electromagnetic coil 32 is energized. Thus, as shown in FIG. 2B, the average discharge pressure is increased as compared to the comparative example. When the electromagnetic coil 32 is deenergized, and the piston 44 is pushed back, hydraulic oil in the second pump chamber 72 is compressed by the back face of the piston main body 44*a*. At this time, the piston 44 is pushed back slowly since this hydraulic oil serves as a resistance. Thus, as shown in FIG. 3, the piston 44 is pushed out again by the subsequent energization (as shown in a solid line A in a in FIG. 3) before the piston 44 completely returns to the original position by the previous deenergization (before the stroke is reduced to zero as shown in a dashed line B in FIG. 3). This can prevent disadvantages, such as generation of a sound of a collision between the plunger 34 and the case 31 which occurs when the piston 44 is pushed back fast by the spring 46 upon deenergization as in the comparative example.

Thus, the electromagnetic pump 20 of the embodiment is formed so that a change in capacity of the first pump chamber 70 is larger than a change in capacity of the second pump chamber 72. Therefore, when the electromagnetic coil 32 is energized, and the piston 44 is pushed out by the electromagnetic force of the solenoid portion 30, hydraulic oil is discharged from the first pump chamber 70 into the discharge oil passage 14 via the discharge check valve 60 and the second pump chamber 72 by an amount corresponding to the difference between a decrease in capacity of the first pump chamber 70 and an increase in capacity of the second pump chamber 72. When the electromagnetic coil 32 is deenergized, and the piston 44 is pushed back by the biasing force of the spring 46, the hydraulic oil is discharged from the second pump chamber 72 directly into the discharge oil passage 14 by an amount corresponding to a decrease in capacity of the second pump chamber 72. In the electromagnetic pump 20 of the embodiment, hydraulic oil is discharged from the first pump chamber 70 into the discharge oil passage 14 via the discharge check valve 60 and the second pump chamber 72 by a force resulting from subtracting the biasing force of the spring 46 from the electromagnetic force of the solenoid portion 30, and hydraulic oil in the second pump chamber 72 is discharged directly into the discharge oil passage 14 by the biasing force of the spring 46. Thus, the electromagnetic pump of the embodiment can use the spring 46 having a relatively weak biasing force, and the solenoid portion 30 having an electromagnetic force that is necessary and sufficient to be able to push out the piston 44 against the biasing force of the spring 46 to pressure-feed hydraulic oil, whereby the pump is reduced in size.

Figure 4:
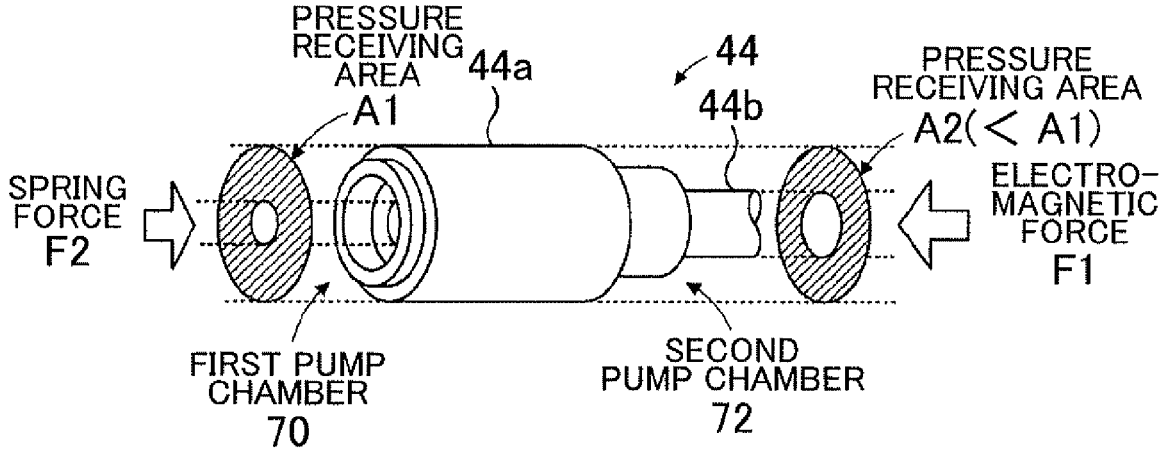
FIG. 4 is a diagram illustrating a pressure receiving area of a front face of a piston in a first pump chamber, and a pressure receiving area of a back face of the piston in a second pump chamber according to the embodiment.

FIG. 4 is a diagram illustrating the pressure receiving area of the front face of the piston 44 in the first pump chamber 70, and the pressure receiving area of the back face of the piston 44 in the second pump chamber 72. Provided that "A1" indicates the pressure receiving area of the front face of the piston 44 in the first pump chamber 70, and "A2" indicates the pressure receiving area of the back face of the piston 44 in the second pump chamber 72, the discharge pressure P1 of hydraulic oil that is discharged from the first pump chamber 70 via the discharge check valve 60 and the second pump chamber 72 by the electromagnetic force of the solenoid portion 30 can be represented by the following expression (1), and the discharge pressure P2 of hydraulic oil that is directly discharged from the second pump chamber 72 by the biasing force (the spring force) F2 of the spring 46 can be represented by the following expression (2). In these expressions, "F1" indicates the electromagnetic force of the solenoid portion 30, "F2" indicates the spring force, and "F3" indicates a force that is generated in a direction opposite to that of the spring force by the negative pressure that is generated in the first pump chamber 70 when the piston 44 is pushed back by the spring force. The force F3 generated by the negative pressure is sufficiently weaker than the spring force F2, and the pressure receiving area A2 in the second pump chamber 72 is smaller than the pressure receiving area A1 in the first pump chamber 70. Thus, the discharge pressure P2 can be made larger than the discharge pressure P1 by making (increasing) the value of the spring force F2 closer to the value of the electromagnetic force F1 within such a range (F1>F2) that the piston 44 can be pushed out by the electromagnetic force F1 against the spring force F2. That is, as shown in FIG. 2B, the peak of the discharge pressure in each overall cycle of the electromagnetic pump 20 can be adjusted by setting the spring force F2 of the spring 46. Thus, even if the electromagnetic force that is generated by the solenoid portion 30 becomes unstable due to, e.g., heat generated in the solenoid portion 30 by continuous use of the electromagnetic pump 20, adverse effects on the pressure-feeding capability of the electromagnetic pump 20 can be reduced. Note that, as shown in the expression (2), by increasing the diameter of the shaft portion 44*b* of the piston 44 to reduce the pressure receiving area of the piston 44 in the second pump chamber 72, the discharge pressure P2 that is generated by the rearward movement of the piston 44 by the spring force F2 is increased, and the discharge amount is reduced. In this case, since the discharge amount resulting from the forward movement of the piston 44 by the electromagnetic force F1 is increased, the discharge amount per cycle does not change.

$$P1=(F1-F2)/A1 \quad (1)$$

$$P2=(F2-F3)/A2 \quad (2)$$

According to the electromagnetic pump 20 of the embodiment described above, the first pump chamber 70 is formed by the inner wall of the cylinder 42 and the front face of the piston main body 44*a*. The groove 42*a* is formed along the entire circumference of the inner wall of the cylinder 42, and the slide surface 42*b* on which the piston main body 44*a* slides, and the slide surface 42*c* on which the shaft portion 44*b* slides are formed with the groove 42*a* interposed therebetween so that there is a difference in level between the slide surfaces 42*b* and 42*c* in the cylinder 42. With the piston 44 being inserted in the cylinder 42, the second pump chamber 72 is formed by the groove 42*a* and the back face of the piston main body 44*a*. When the electromagnetic coil 32 is energized, the piston 44 is pushed out by the electromagnetic force of the solenoid portion 30, whereby hydraulic oil in the first pump chamber 70 is compressed, and fed into the second pump chamber 72. When the electromagnetic coil 32 is deenergized, the piston 44 is pushed back by the biasing force of the spring 46, and hydraulic oil can be introduced into the first pump chamber 70, while the hydraulic oil in the second oil chamber 72 can be compressed and pressure-fed. Thus, the pressure-feeding capability can be further improved. Therefore, the pump can be reduced in size by designing the electromagnetic pump that satisfies necessary and sufficient pressure-feeding capability, according to the above structure. Since the second pump chamber 72 is formed, hydraulic oil in the second pump chamber 72 functions as a damper when the piston 44 is pushed back by the biasing force of the spring 46. This can prevent a collision between the plunger 34 and the case 31 which occurs when the piston 44 is pushed back fast, and thus, can reduce generation of abnormal noises such as a sound of the collision.

According to the electromagnetic pump 20 of the present embodiment, hydraulic coil is discharged from the first pump chamber 70 into the discharge oil passage 14 via the discharge check valve 60 and the second pump chamber 72 by a force resulting from subtracting the biasing force of the spring 46 from the electromagnetic force of the solenoid portion 30, and hydraulic oil in the second pump chamber 72 is directly discharged into the discharge oil passage 14 by the biasing force of the spring 46. Thus, the electromagnetic pump 20 of the embodiment can use the spring 46 having a relatively weak biasing force, and the solenoid portion 30 having a weak electromagnetic force according to the biasing force of the spring 46, whereby the pump can be reduced in size. Moreover, the peak of the overall discharge pressure of the electromagnetic pump 20 can be adjusted by setting the spring force of the spring 46. Thus, adverse effects on the pressure-feeding capability of the electromagnetic pump 20 can be reduced even if the electromagnetic force that is generated by the solenoid portion 30 becomes unstable.

Figure 5:
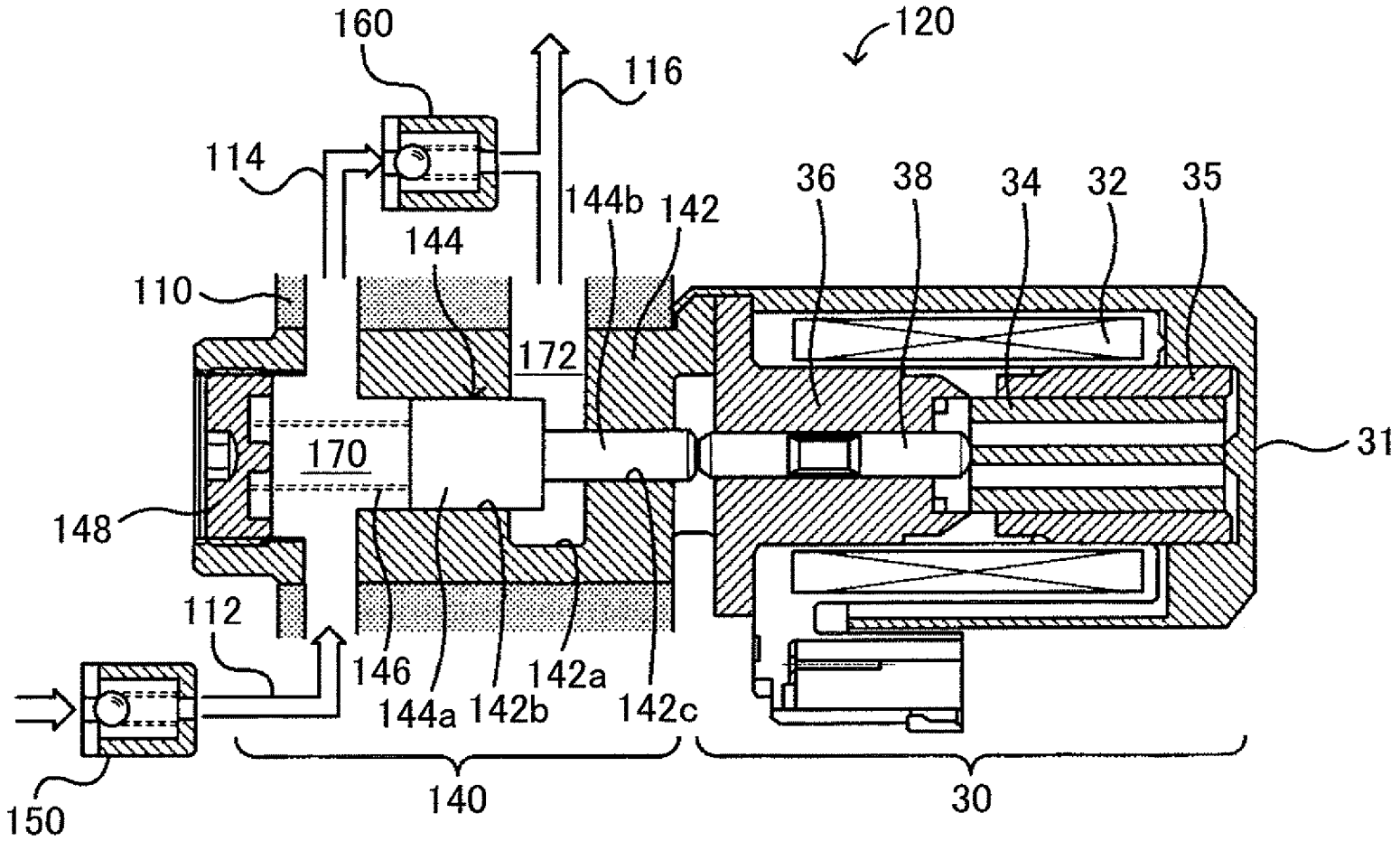
FIG. 5 is a structural diagram showing an overview of the structure of an electromagnetic pump according to a modification of the present invention.

In the electromagnetic pump 20 of the present embodiment, the intake check valve 50 and the discharge check valve 60 are built into the cylinder 42. However, one of the intake check valve 50 and the discharge check valve 60 may be positioned in a valve body 110 located outside the cylinder 42, or both the intake check valve 50 and the discharge check valve 60 may be positioned in the valve body 110 located outside the cylinder 42. FIG. 5 shows an overview of the structure of an electromagnetic pump 120 in a modification of the latter case. Note that, in the figure, the same structure as that of the electromagnetic pump 20 of the embodiment is denoted by the same reference characters, and description thereof will be omitted. In the electromagnetic pump 120 of the modification, a pump portion 140 includes a hollow cylindrical cylinder 142, a piston 144, a spring 146, and an end plate 148. The piston 144 is formed by a cylindrical piston main body 144*a*, and a shaft portion 144*b* having a smaller outer diameter than that of the piston main body 144*a*, and is inserted in the cylinder 142 so as to slide therein. The spring 146 biases the piston 144 in a direction opposite to that of an electromagnetic force of the solenoid portion 30. The end plate 148 serves as a spring receiver. A first pump chamber 170 is formed by the inner wall of the cylinder 142, the front face of the piston main body 144*a*, and the end plate 148. A groove 142*a* is formed along the entire circumference of the inner wall of the cylinder 142. A slide surface 142*b* on which the piston main body 144*a* slides, and a slide surface 142*c* on which the shaft portion 144*b* slides are formed with the groove 142*a* interposed therebetween so that there is a difference in level between the slide surfaces 142*b* and 142*c* in the cylinder 142. With the piston 144 being inserted in the cylinder 142, a second pump chamber 172 is formed by the groove 142*a* and the back face of the piston main body 144*a*. An intake oil passage 112 formed in the valve body 110, and a connecting oil passage 114 formed in the valve body 110 are connected to the first pump chamber 170. The connecting oil passage 114 and a discharge oil passage 116 are connected to the second pump chamber 172. The discharge oil passage 116 is formed in the valve body 110, and extends to devices that are hydraulically driven, such as clutches. The intake oil passage 112 and the connecting oil passage 114 are provided with an intake check valve 150 and a discharge check valve 160, respectively. Hydraulic oil from the oil pan is introduced into the first pump chamber 170 via the intake oil passage 112 and the intake check valve 150, and the hydraulic oil in the first pump chamber 170 is fed into the second pump chamber 172 via the connecting oil passage 114 and the discharge check valve 160, and is further pressure-fed from the second pump chamber 172 via the discharge oil passage 116 to the devices that are hydraulically driven.

In the electromagnetic pump 20 of the present embodiment, the second pump chamber 72 is formed by the groove 42*a* that is formed along the entire circumference of the inner wall of the cylinder 42, and the back face of the piston main body 44*a*. However, the groove 42*a* need not necessarily be formed, and the pump chamber may have any shape as long as the capacity of the pump chamber can be reduced as the piston 44 is pushed back by the biasing force of the spring 46.

In the electromagnetic pump 20 of the embodiment, the shaft portion 44*b* of the piston 44, and the shaft 38 and the plunger 34 of the electromagnetic portion 30 are formed as separate members. However, the shaft portion 44*b*, the shaft 38 and the plunger 34 may be formed integrally.

The electromagnetic pump 20 of the present embodiment is used to supply an oil pressure for turning on/off clutches and brakes of an automatic transmission that is mounted on a vehicle. However, the present invention is not limited to this, and the electromagnetic pump of the present invention may be applied to any system for transferring fuel, transferring a liquid for lubrication, or the like.

In the embodiment, the piston 44 functions as the "piston," the solenoid portion 30 functions as the "electromagnetic portion," the spring 46 functions as the "elastic member," the intake check valve 50 functions as the "first on-off valve," the discharge check valve 60 functions as the "second on-off valve," the first pump chamber 70 functions as the "first fluid chamber," and the second pump chamber 72 functions as the "second fluid chamber," The "object to be operated" functions as, e.g., a fluid pressure servo of a friction engagement element of an automatic transmission.

Although the embodiment of the present invention was described above, it is to be understood that the present invention is not limited in any way to the embodiment, and can be embodied in various forms without departing from the spirit and scope of the present invention.

The present invention can be used in the electromagnetic pump manufacturing industry, the automobile industry, and the like.

The invention claimed is:

1. An electromagnetic pump, comprising:

a piston that is slidably provided in a cylinder and the piston oriented in the cylinder so as to partition a first fluid chamber and a second fluid chamber connected to an object to be operated;

an elastic member oriented in the first fluid chamber and configured to move the piston backward by applying an elastic force;

an electromagnetic portion configured with a plunger that is connected by a shaft to the piston in an axial direction of the piston, the electromagnetic portion and plunger arranged outside of the cylinder, and the electromagnetic portion configured to move the plunger, shaft and piston forward by an electromagnetic force in a direction opposite to that of the elastic force of the elastic member;

a first on-off valve that allows working fluid to flow from outside into the first fluid chamber and prevents working fluid from flowing from the first fluid chamber to the outside; and a second on-off valve that is provided in a connecting flow passage that connects the first fluid chamber and the second fluid chamber to each other, allows working fluid to flow from the first fluid chamber into the second fluid chamber, and prevents working fluid from flowing from the second fluid chamber into the first fluid chamber, wherein a capacity of the first fluid chamber reduces and a capacity of the second fluid chamber increases when the piston is moved forward, and the capacity of the first fluid chamber increases and the capacity of the second fluid chamber reduces when the piston is moved backward, and a change in capacity of the first fluid chamber is larger than a change in capacity of the second fluid chamber in a reciprocating motion of the piston.

2. The electromagnetic pump according to claim 1, wherein an area of a pressure receiving surface of the piston in the first fluid chamber is larger than that of a pressure receiving surface of the piston in the second fluid chamber.

3. The electromagnetic pump according to claim 1, wherein a fluid pressure of working fluid that is discharged from the second fluid chamber to the object to be operated when the piston is moved backward by the elastic force of the elastic member, is larger than that of working fluid that is discharged from the first fluid chamber to the object to be operated via the second on-off valve and the second fluid chamber when the piston is moved forward by the electromagnetic force of the electromagnetic portion.

4. The electromagnetic pump according to claim 1, wherein:

the piston includes a cylindrical piston main body and a shaft portion that is connected to the piston main body and has an outer diameter smaller than that of the piston main body;

the cylinder includes a slide surface on which the piston main body slides and a slide surface on which the shaft portion slides, where these slide surfaces are formed so that there is a difference in level therebetween in the cylinder; and the second fluid chamber is a space surrounded by the cylinder and the piston, with the piston being inserted in the cylinder.

5. The electromagnetic pump according to claim 1, wherein:

the electromagnetic portion includes a mover that drives the piston and a case that accommodates the mover;

the mover moves away from the case by the electromagnetic force when the electromagnetic portion is energized; and the mover moves toward the case together with the piston by the elastic force of the elastic member when the electromagnetic portion is deenergized.

6. The electromagnetic pump according to claim 1, wherein the first and second on-off valves are check valves.

7. The electromagnetic pump according to claim 1, wherein the first and second on-off valves are built into the cylinder.

8. The electromagnetic pump according to claim 7, wherein the second on-off valve is built into the piston.

9. The electromagnetic pump according to claim 8, wherein:

the second on-off valve includes a main body formed integrally with the piston and an open/close member that opens and closes the central hole;

the main body includes a central hole formed around the same axis as the piston and a through hole formed radially so as to communicate with a central hole; and the central hole and the through hole are used as the connecting flow passage that communicates the first fluid chamber and the second fluid chamber to each other.

10. The electromagnetic pump according to claim 1, wherein at least one of the first on-off valve and the second on-off valve is positioned outside the cylinder.

11. The electromagnetic pump according to claim 1, wherein the elastic member is attached to the first fluid chamber.

12. The electromagnetic pump according to claim 1, wherein the shaft and plunger are monolithically formed of a single piece without joints or seams.

* * * * *